United States Patent [19]

Baxter

[11] Patent Number: 4,793,498

[45] Date of Patent: Dec. 27, 1988

[54] CAP FOR A CONTAINER CLOSURE

[75] Inventor: Alan A. Baxter, Colchester, United Kingdom

[73] Assignee: National Plastics Limited, United Kingdom

[21] Appl. No.: 99,252

[22] Filed: Sep. 21, 1987

[30] Foreign Application Priority Data

Sep. 25, 1986 [GB] United Kingdom ..... 8623064

[51] Int. Cl.[4] ..... B65D 41/34

[52] U.S. Cl. ..... 215/230; 215/252

[58] Field of Search ..... 215/252, 230

[56] References Cited

U.S. PATENT DOCUMENTS

| | | | |
|---|---|---|---|
| 3,310,191 | 3/1967 | Kern et al. | 215/252 |
| 4,493,427 | 1/1985 | Wolkonsky | 215/252 |
| 4,527,705 | 7/1984 | Prades | 215/252 |

FOREIGN PATENT DOCUMENTS

| | | | |
|---|---|---|---|
| 0086970 | 8/1983 | European Pat. Off. . | |
| 2290364 | 6/1976 | France | 215/252 |
| 2490598 | 3/1982 | France | 215/252 |

*Primary Examiner*—Donald F. Norton

*Attorney, Agent, or Firm*—Emrich & Dithmar

[57] ABSTRACT

A cap for a container closure is adapted to receive an insert by engagement of a projection on the insert in a recess in the cap. The cap is recessed to receive the insert in a region near the open mouth of the cap. The cap is outwardly flared in this region so that no significant reduction in wall thickness of the cap occurs in this region, the outer form of the flaring comprising a smooth curve which, in the direction towards the mouth opening of the cap comprises a portion which has an outwardly presented concave curve swelling smoothly from the upper wall of the cap and merging by a convex curve into the lower, larger diameter wall of the cap.

7 Claims, 2 Drawing Sheets

CAP FOR A CONTAINER CLOSURE

TECHNICAL FIELD

This invention relates to a cap for a container closure which is adapted to receive and interengage with an insert to form the container closure.

The insert may, for example, incorporate a guarantee band, that is a band which will engage below a bead formed around a container neck, when the closure is applied to the container, and which is so formed that it cannot subsequently be removed from the container without breaking the band and/or breaking the connection of the band to the closure. Thus, the fact that the guarantee band, and therefore the closure to which it is attached, has been removed from the container becomes visible and such bands are sometimes known as tamper-indicating bands.

DISCUSSION OF PRIOR ART

It is convenient, in order to facilitate the removal of parts from a mould to mould the cap of the closure separately from a part comprising an element constituting the guarantee band and an element to which the guarantee band is attached by breakable connections and which serves to attach this part to the cap by means of a projecting annular rib which engages in an annular recess provided in the wall of the cap.

The present invention relates to the form of the cap of such a two-part closure and is concerned to provide a cap which is convenient to mould and reliably strong in use.

SUMMARY OF THE INVENTION

According to one aspect of the invention, there is provided a cap for a container closure comprising a cap and an inset adapted to be received in the cap and retained therein by engagement of a projection on the insert in a recess in the cap, wherein said cap is recessed to receive and interengage with the insert in a region near the open mouth of the cap, the cap is outwardly flared in this region so that no significant reduction in wall thickness of the cap occurs in this region, the outer form of the flaring comprising a smooth curve which, in the direction towards the mouth opening of the cap comprises a portion which has an outwardly presented concave curve swelling smoothly from the upper wall of the cap and merging by a convex curve (preferably a shaper convex curve) into the lower, larger diameter wall of the cap.

Desirably the recessing of the cap is by way of an annular recess or a plurality of recesses in an annular region of the cap and the or each recess has a lower edge (nearer the mouth opening of the cap) inclined at an angle no greater than 70° and no less than 60° to the axis of the cap.

Preferably, the intersection of the said lower edge of the or each recess with the base of the recess is constituted by a sharp corner defined, substantially, by the intersection of plane surfaces, and the outer lip of the said lower edge of the or each recess is convexly curved, for example it may be a part-circular configuration in cross-section with a radius in the range of 0.25 to 0.35 mm.

The measures just mentioned provide a form of recess which shows good retention of an appropriately shaped projection on the insert but which facilitates moulding of the cap.

BRIEF DESCRIPTION OF THE DRAWINGS

The invention will be further described, by way of example, with reference to the accompanying drawings, in which.

DESCRIPTION OF PREFERRED EMBODIMENT

Figure 1:
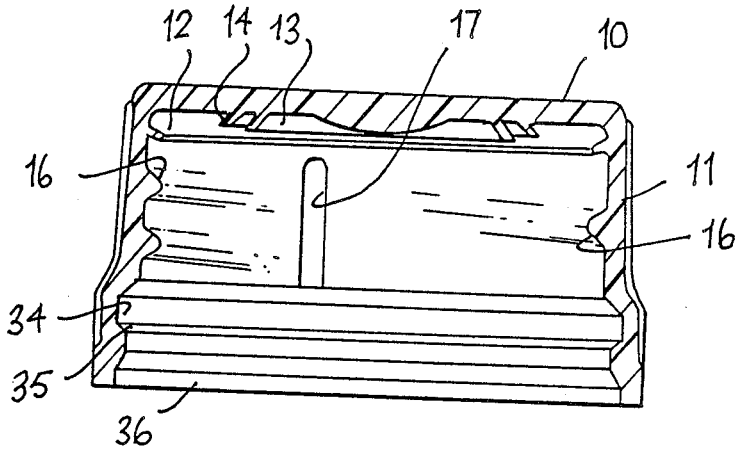
FIG. 1 is a cross-section through a cap according to the invention.

The cap shown in the drawings which, together with the insert also shown may be made by injection moulding in synthetic plastics material, for example polyethylene or polypropylene, comprises an end wall 10 and a generally cylindrical side wall 11. The end wall 10 has internal annular lips 12 and 13 and a ring of retaining members 14 to retain in the cap a sealing gasket 15 formed by running gasket material in a liquid state into the cap and solidifying and curing it. The side wall 11 has an internal screw thread 16 for engagement with a corresponding screw thread on the neck of a container, and one or more axial slots 17 to relieve the pressure in a container to which the cap is applied immediately the sealing gasket 15 lifts away from the open end of the container at the start of the operation of removing the cap.

Figure 3:
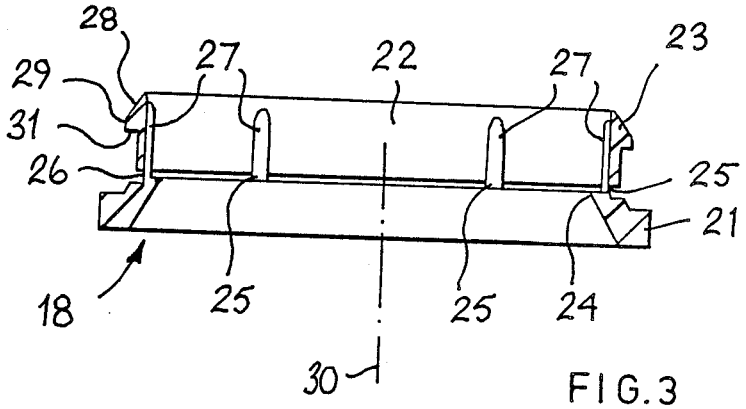
FIG. 3 is a cross-section through an insert for attachment to the cap of FIG. 1.
Figure 2:
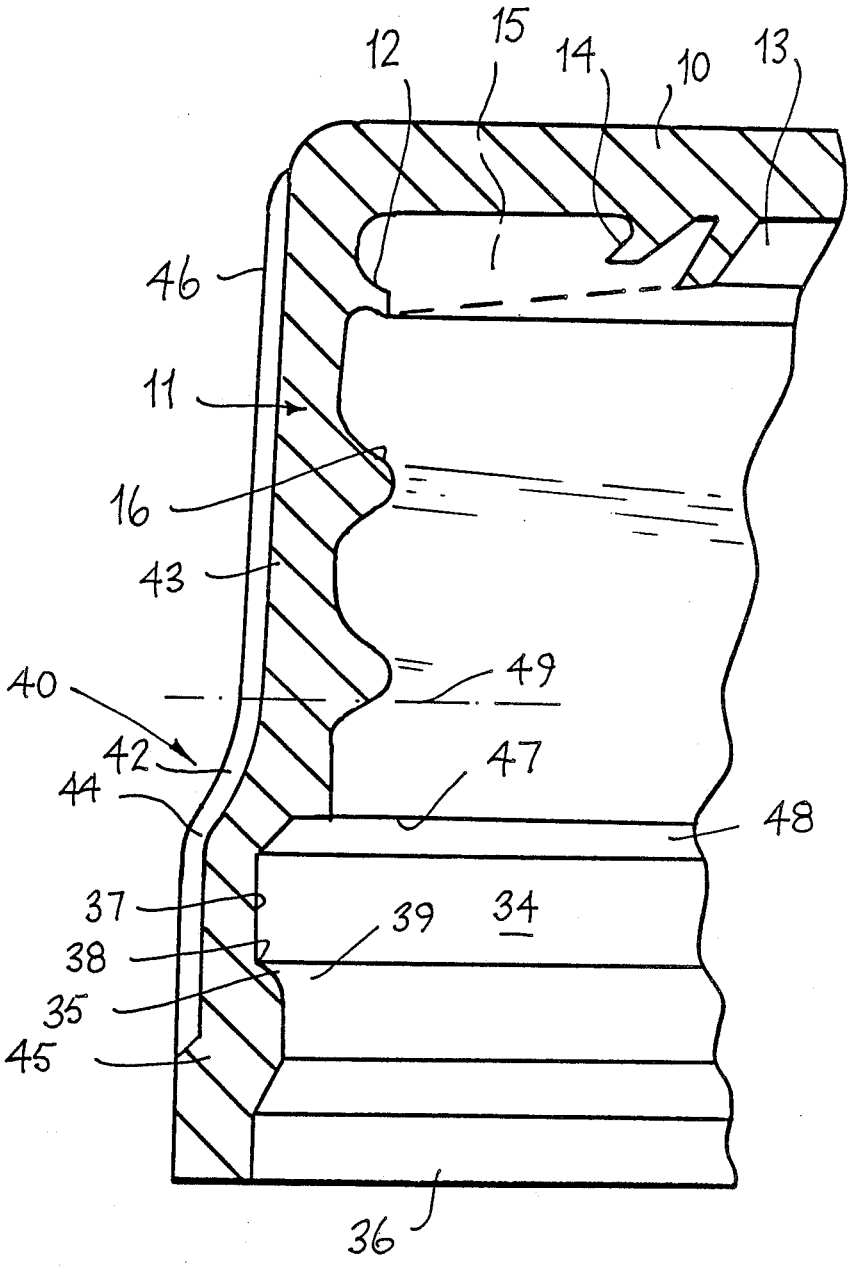
FIG. 2 is a cross-section on an enlarged scale of part of the cap of FIG. 1.

The cap is adapted to receive and interengage with an insert to form a container closure in which the insert is attached to the cap. An insert 18 incorporating a guarantee band is shown in FIG. 3 but such inserts may incorporate other elements for a closure in addition to or instead of a guarantee band.

The insert 18 comprises two elements; a guarantee band 21, and an annulus 22 having a projecting lip 23 for engagement in an annular recess 34 provided internally of the cap wall.

The guarantee band 21 has an internally projecting rib 24 for engagement under a bead of a container so that after application to a suitable container of a closure comprising a cap with an insert 18 attached to it, the closure cannot be removed from the container without breaking the guarantee band 21, and/or its connection to the annulus 22. In the present case, the guarantee band is connected to the annulus 22 by breakable bridges 25. A further bridge 26 may be stronger than the bridges 25 so that it does not break and the guarantee band remains attached to the annulus 22 and the cap after removal of the cap from a suitable container. The bridges 25 and 26 are extensions of internal axially extending ribs 27 formed on the annulus 22 for a purpose mentioned below.

The projecting lip 23 has a downwardly and outwardly inclined surface 28, a short cylindrical surface 29 parallel to the axis 30 of the insert and an under-surface 31 which is substantially flat and extends at right angles to the axis of the insert. In the present example of an insert for a cap having a maximum external diameter of approximately 38 mm, the height of the surface 29 may be 1.0 mm whereas the total height of the projecting lip is 2.3 mm and the vertical height of the inclined surface 28 is 1.3 mm. The total height of the annulus 22 is 4.6 mm and the depth of projecting lip 23 (i.e. the width of the surface 31) is 0.5 mm. The surface 28 makes an angle of 25° with the axis 30 of the insert and serves to guide the insert into the cap when the insert is to be attached to the cap.

The projecting lip 23 of the annulus 22 engages in the annular recess 34 formed internally of the side wall 11 of the cap. The recess 34 has a lower edge 35 nearer a mouth opening 36 of the cap which is inclined at an angle of 60° to the axis of the cap (that is at an angle of 30° to a radius of the cap). The inclination of this edge 35 assists in ejection of the cap from the mould but too great an inclination may allow the insert 18 to escape from the cap under some circumstances. Thus the inclination of the edge 35 to the axis of the cap should be no less than 60° and no more than 70° (30° and 20° respectively in relation to the radius direction of the cap).

Retention of the lip 23 of the insert 18 in the recess 34 is assisted if, as in the present example, the intersection of the lower edge 35 with the base 37 of the recess 34 is constituted by a sharp corner 38 defined by the intersection of substantially plane surfaces constituting the edge 35 and base 37. Ejection from the mould is facilitated if the outer lip 39 of the edge 35 is convexly curved, as in the present example. Here, the lip 39 is part-circular in cross-section with a radius of 0.3 mm (advantageously 0.25 to 0.35 mm). The depth of the recess 34, that is the width of the edge 35 (in the direction at right angles to the axis of the cap) is 0.5 mm so that the radius of the lip 39 is 3/5 of the depth of the recess and the depth of the recess 34 is equal to the depth of the projecting lip 23.

In order to retain the wall strength of the side wall 11 in a flared region 40 near the open mouth 36 of the cap, the wall thickness and thus the strength of the side wall 11 are maintained without significant reduction. The outer form of the flared region is such that it comprises a smooth curve which, in the direction towards the mouth opening of the cap comprises a portion 42 which is outwardly concave and swells smoothly from the upper wall 43 of the cap and merges through a sharper outwardly convex curve 44 into the lower, larger diameter wall 45 of the cap. An outer knurling 46 is retained on the external surface of the cap through the flared region 40 almost down to the open mouth 36 of the cap.

The inner surface of the cap in the flared region 40 comprises a region 47 extending at right angles to the axis of the cap and a downwardly and outwardly inclined region 48 which together form the upper edge of the recess 34 and are located and dimensioned in relation to the outer surface of the side wall 11 in the flared region 40 that the wall thickness in the flared region 40 does not fall below the wall thickness of 0.75 mm at a level 49 where the flaring commences and is usually above this, reaching a maximum of 1,2 mm at a level where the change from an outwardly concave to an outwardly convex curvature takes place.

When a closure comprising a cap with an insert 18 introduced into it is applied to a container, the ribs 27 on the annulus 22 will engage against the bead on the neck of the container and serve to urge the projecting lip 23 into the recess 34.

It is preferred, in the present example, to make the cap of polypropylene because its resistance to high temperatures permits high temperature curing of gasket material introduced into it. The preferred material for the insert 18 is low density polyethylene because this allows the guarantee band to stretch more readily to pass over the retaining bead on a container neck when the closure is applied to a container and it also allows the insert 18 to be pushed into a cap more easily.

When moulded from two different materials, a colour contrast can be provided between the cap and the insert which can make it easier to spot when a guarantee band has been broken.

What is claimed is:

1. A cap for a container closure comprising a cap and an insert adapted to be received in the cap and retained therein by engagement of a projection on the insert in a recess in the cap, wherein said cap has an annular wall portion having a recess in an inner surface thereof in a region near the open mouth of the cap to receive and interengage with the insert, said recess having an edge, nearer the mouth opening of the cap, which is inclined at an angle no greater than 70° and no less than 60° to the axis of the cap, the cap is outwardly flared in this region so that no significant reduction in wall thickness of the cap occurs in this region, and the outer surface of the cap flared region has a smooth curve which, in the direction towards the mouth opening of the cap, comprises a concave portion and a convex portion, the concave portion of the curve swelling smoothly from the upper wall of the cap and merging by the convex portion into the lower larger diameter wall of the cap.

2. A cap as claimed in claim 1, wherein the recess has a base and the intersection of said edge of the recess with the base of the recess is constituted by a sharp corner defined, substantially, by the intersection of plane surfaces, and said edge of the recess defining an outer lip portion which is convexly curved.

3. A cap as claimed in claim 2, wherein said lip portion of said outer surface is part-circular in configuration with a radius in the range of 0.25 to 0.35 mm.

4. A cap as claimed in claim 2, wherein said lip portion has a part-circular cross-sectional configuration with a radius some 60% of the depth of the recess as measured in the radial direction of the cap.

5. A cap as claimed in claim 1, which is injection moulded from a synthetic plastics material resistant to the curing temperature of a gasket material cured in-situ in the cap and said insert being injection moulded from a low density polyethylene material.

6. A cap as claimed in claim 5, wherein a colour contrast is provided between the two materials used for the cap and the insert.

7. A cap as claimed in claim 1, wherein the convex portion of said cap outer surface has a radius of curvature less than that of the concave portion of said outer surface with which it is merged.

* * * * *